US010059074B2

(12) United States Patent
Makita et al.

(10) Patent No.: US 10,059,074 B2
(45) Date of Patent: Aug. 28, 2018

(54) BINDING PROCESSING APPARATUS AND IMAGE FORMING SYSTEM

(71) Applicant: FUJI XEROX CO., LTD., Tokyo (JP)

(72) Inventors: Takuya Makita, Kanagawa (JP); Hiroaki Awano, Kanagawa (JP); Yoshinori Nakano, Kanagawa (JP); Katsumi Harada, Kanagawa (JP); Kojiro Tsutsumi, Kanagawa (JP); Yasuhiro Kusumoto, Kanagawa (JP); Hiroshi Hagiwara, Kanagawa (JP); Emiko Shiraishi, Kanagawa (JP); Junichi Hirota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 56 days.

(21) Appl. No.: 15/257,953

(22) Filed: Sep. 7, 2016

(65) Prior Publication Data

US 2017/0282483 A1 Oct. 5, 2017

(30) Foreign Application Priority Data

Mar. 29, 2016 (JP) ..... 2016-066524

(51) Int. Cl.
*B31F 5/02* (2006.01)
*B65H 37/04* (2006.01)
*G03G 15/00* (2006.01)

(52) U.S. Cl.
CPC ..... *B31F 5/02* (2013.01); *B65H 37/04* (2013.01); *G03G 15/6541* (2013.01); *B65H 2801/27* (2013.01)

(58) Field of Classification Search
CPC ..... G03G 15/6544; G03G 2215/00852; B31F 1/07; B31F 5/02; B31F 2201/0712;
(Continued)

(56) References Cited

U.S. PATENT DOCUMENTS 8,246,033 B2 * 8/2012 Sato ..... B42C 1/12 270/58.07
8,596,633 B2 * 12/2013 Awaya ..... B65H 37/04 270/58.07

(Continued)

FOREIGN PATENT DOCUMENTS

JP 2004-155537 A * 6/2004
JP 2004-167700 A * 6/2004

(Continued)

OTHER PUBLICATIONS

Machine Translation of JP 2010-274623 A, Japan Platform for Patent Information.*

(Continued)

*Primary Examiner* — Leslie A Nicholson, III
(74) *Attorney, Agent, or Firm* — Sughrue Mion, PLLC

(57) ABSTRACT

A binding processing apparatus includes: a pressure-applying member pair that has multiple projections arranged side-by-side and applies pressure to a sheet stack by pressing the projections against the sheet stack; and an advancing-and-retracting part that causes at least one of the pressure-applying members in the pressure-applying member pair to move toward or away from the other pressure-applying member. A pitch of the projections in each pressure-applying member is from 1.2 mm to 1.5 mm, and a height of the projections is from 0.55 mm to 0.75 mm, and a load per unit area applied from each pressure-applying member to the sheet stack when the pressure-applying member applies pressure to the sheet stack is from 42 N/mm$^2$ to 94 N/mm$^2$.

11 Claims, 12 Drawing Sheets

(58) Field of Classification Search
CPC ..... B65H 37/04; B65H 2301/51616; B65H 2301/43828
USPC ..... 270/58.07, 58.08; 493/390
See application file for complete search history.

(56) References Cited

U.S. PATENT DOCUMENTS

| | | | | |
|---|---|---|---|---|
| 8,991,808 | B2 * | 3/2015 | Suzuki | B65H 39/00 270/58.07 |
| 2009/0133180 | A1 * | 5/2009 | Morita | B29C 55/18 2/79 |
| 2012/0273148 | A1 * | 11/2012 | Orr | D21H 27/002 162/204 |
| 2015/0076759 | A1 * | 3/2015 | Kosuge | B42F 1/00 270/1.01 |

FOREIGN PATENT DOCUMENTS

| | | | |
|---|---|---|---|
| JP | 2004-168435 | A * | 6/2004 |
| JP | 2010-274623 | A | 12/2010 |

OTHER PUBLICATIONS

Machine Translation of JP 2004-167700A, Japan Platform for Patent Information.*

* cited by examiner

FIG. 8A

| | 10 | 18 | 26 | 34 | 42 | 50 | 62 | 70 | 78 | 86 | 94 | 108 |
|---|---|---|---|---|---|---|---|---|---|---|---|---|
| 2-3 SHEETS | △ | ○ | ○ | ○ | △ | × | × | × | × | × | × | × |
| 4-5 SHEETS | × | △ | ○ | ○ | ○ | △ | × | × | × | × | × | × |
| 6-9 SHEETS | × | × | × | × | × | × | × | × | × | × | × | × |
| 10-15 SHEETS | × | × | × | × | × | × | × | × | × | × | × | × |

○ : 200 gf OR MORE, △ : 100–200 gf, × : 100 gf OR LESS

FIG. 8B

| | 10 | 18 | 26 | 34 | 42 | 50 | 62 | 70 | 78 | 86 | 94 | 108 |
|---|---|---|---|---|---|---|---|---|---|---|---|---|
| 2-3 SHEETS | × | △ | ○ | ○ | ○ | ○ | ○ | ○ | ○ | ○ | △ | × |
| 4-5 SHEETS | × | × | △ | ○ | ○ | ○ | ○ | ○ | ○ | ○ | ○ | △ |
| 6-9 SHEETS | × | × | × | △ | ○ | ○ | ○ | ○ | ○ | ○ | ○ | ○ |
| 10-15 SHEETS | × | × | × | × | △ | ○ | ○ | ○ | ○ | ○ | ○ | ○ |

○ : 200 gf OR MORE, △ : 100–200 gf, × : 100 gf OR LESS

FIG. 8C

| | 10 | 18 | 26 | 34 | 42 | 50 | 62 | 70 | 78 | 86 | 94 | 108 |
|---|---|---|---|---|---|---|---|---|---|---|---|---|
| 2-3 SHEETS | × | × | × | × | × | × | × | × | × | × | × | × |
| 4-5 SHEETS | × | × | × | × | × | × | × | × | × | × | × | × |
| 6-9 SHEETS | × | × | × | × | × | × | × | × | × | △ | ○ | ○ |
| 10-15 SHEETS | × | × | × | × | × | × | × | × | × | × | △ | ○ |

○ : 200 gf OR MORE, △ : 100–200 gf, × : 100 gf OR LESS

BINDING PROCESSING APPARATUS AND IMAGE FORMING SYSTEM

CROSS-REFERENCE TO RELATED APPLICATIONS

This application is based on and claims priority under 35 USC 119 from Japanese Patent Application No. 2016-066524 filed Mar. 29, 2016.

BACKGROUND

Technical Field

The present invention relates to a binding processing apparatus and an image forming system.

SUMMARY

According to an aspect, there is provided a binding processing apparatus including: a pressure-applying member pair that has multiple projections arranged side-by-side and applies pressure to a sheet stack by pressing the projections against the sheet stack; and an advancing-and-retracting part that causes at least one of the pressure-applying members in the pressure-applying member pair to move toward or away from the other pressure-applying member. A pitch of the projections in each pressure-applying member is from 1.2 mm to 1.5 mm, and a height of the projections is from 0.55 mm to 0.75 mm, and a load per unit area applied from each pressure-applying member to the sheet stack when the pressure-applying member applies pressure to the sheet stack is from 42 N/mm$^2$ to 94 N/mm$^2$.

BRIEF DESCRIPTION OF THE DRAWINGS

Exemplary embodiment of the present invention will be described in detail based on the following figures, wherein:

FIGS. 8A to 8C show results of binding processing performed with the first pressure-applying member pair, in an example and comparative examples;

DETAILED DESCRIPTION

Referring to the attached drawings, an exemplary embodiment of the present invention will be described in detail below.

Figure 1:
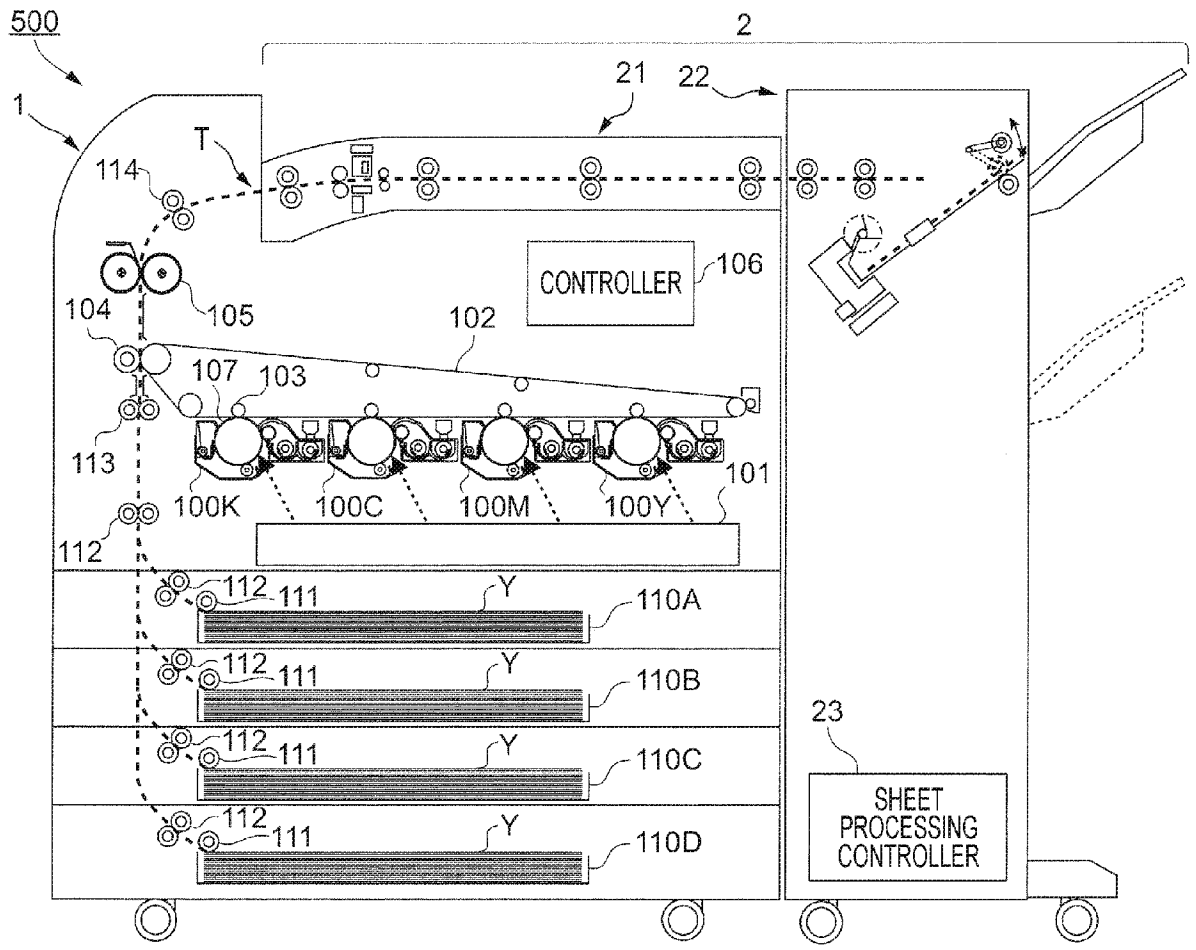
FIG. 1 shows the configuration of an image forming system.

FIG. 1 shows the configuration of an image forming system 500 to which this exemplary embodiment is applied.

The image forming system 500 shown in FIG. 1 includes an image forming apparatus 1 (a printer, a copier, or the like) that forms a color image on a sheet Y, and a post-processing apparatus 2 that performs post-processing, such as binding, on the sheet Y having an image formed thereon by the image forming apparatus 1.

The image forming apparatus 1, serving as an example of an image forming part, includes four image forming units 100Y, 100M, 100C, and 100K (also collectively referred to as "image forming units 100") that form images on the basis of the corresponding color image data.

The image forming apparatus 1 also includes a laser exposure device 101 that irradiates photoconductor drums 107 of the image forming units 100 with light. The image forming apparatus 1 also includes an intermediate transfer belt 102, to which color toner images formed in the image forming units 100 are transferred in a superimposed manner.

The image forming apparatus 1 also includes a first transfer roller 103 that sequentially transfers (first-transfers) the color toner images formed in the image forming units 100 to the intermediate transfer belt 102, a second transfer roller 104 that simultaneously transfers (second-transfers) the color toner images transferred to the intermediate transfer belt 102 to a sheet Y, and a fixing device 105 that fixes the second-transferred color toner images to the sheet Y. The image forming apparatus 1 also includes a controller 106 for controlling the operation of the image forming apparatus 1. The controller 106 includes a central processing unit (CPU) controlled by a program.

The image forming units 100 of the image forming apparatus 1 form the color toner images through: charging the photoconductor drums 107; forming electrostatic latent images on the photoconductor drums 107 by scanning the photoconductor drums 107 with light from the laser exposure device 101; developing the thus-formed electrostatic latent images with color toners; and the like.

The color toner images formed on the image forming units 100 are sequentially electrostatically transferred to the intermediate transfer belt 102 by the first transfer roller 103. Then, the color toner images are transported to the position of the second transfer roller 104 by the movement of the intermediate transfer belt 102.

In the image forming apparatus 1, different sizes and types of sheets Y are stored in sheet containers 110A to 110D.

When an image is to be formed on a sheet Y, for example, a sheet Y is picked up from the sheet container 110A by the pick-up roller 111 and is transported to the position of registration rollers 113 by transport rollers 112.

Then, the registration rollers 113 feed the sheet Y in accordance with the timing when the color toner images on the intermediate transfer belt 102 are transported to the position of the second transfer roller 104.

As a result, the color toner images are simultaneously electrostatically transferred (second-transferred) to the sheet Y, due to an effect of a transfer electric field formed by the second transfer roller 104.

Thereafter, the sheet Y to which the color toner images have been second-transferred is separated from the intermediate transfer belt 102 and is transported to the fixing device 105. In the fixing device 105, the color toner images are fixed to the sheet Y through fixing processing utilizing heat and pressure, and thus, the image is formed.

The sheet Y having an image formed thereon is discharged from a sheet discharge part T in the image forming apparatus 1 by the transport roller 114 and is then fed to the post-processing apparatus 2.

The post-processing apparatus 2, serving as an example of a binding processing apparatus, is disposed downstream of the sheet discharge part T in the image forming apparatus 1 and performs post-processing, such as punching and binding, on the sheet Y having an image formed thereon.

Figure 2:
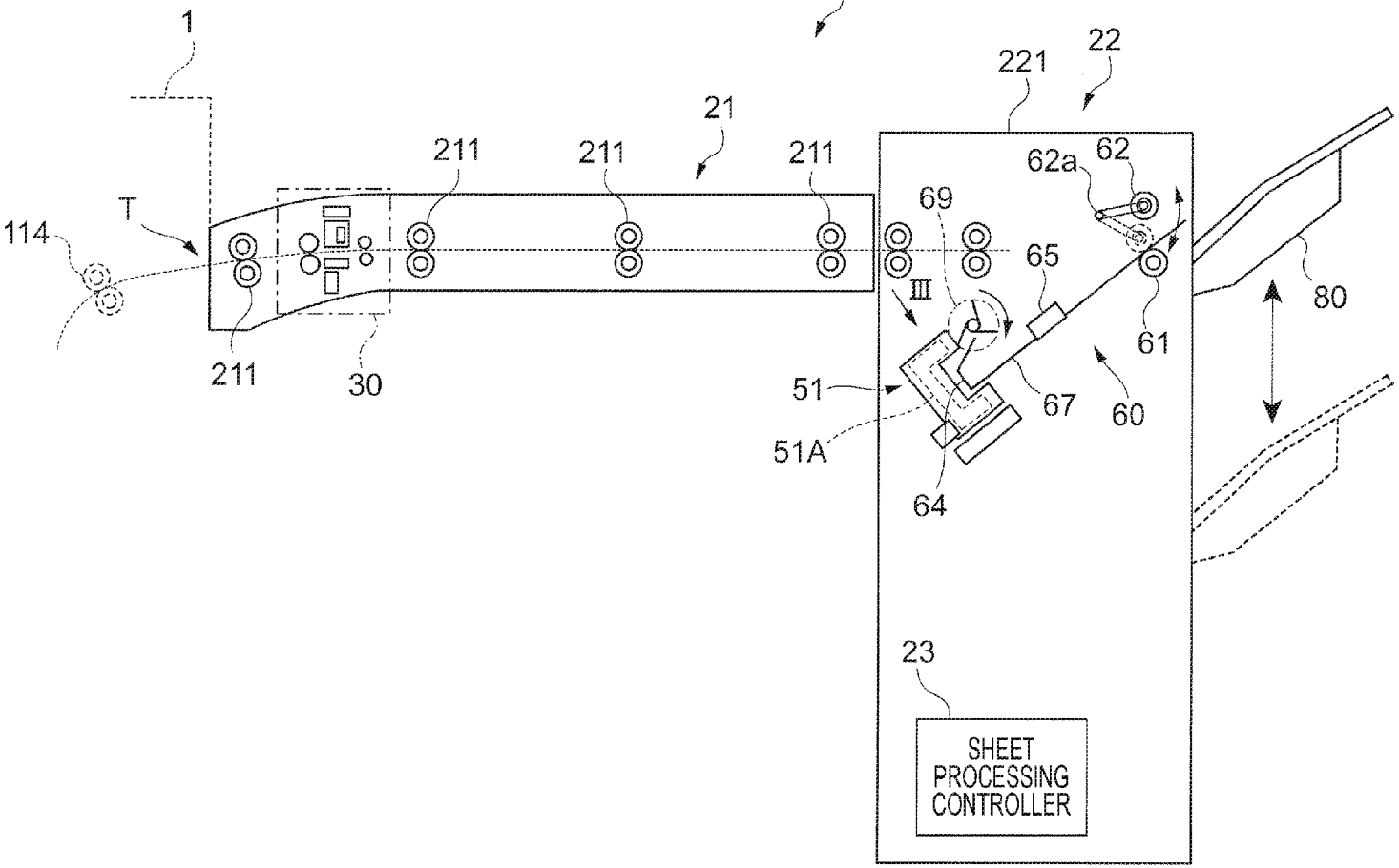
FIG. 2 shows the configuration of a post-processing apparatus.

FIG. 2 shows the configuration of the post-processing apparatus 2.

The post-processing apparatus 2 includes a transport unit 21, which is connected to the sheet discharge part T in the image forming apparatus 1, and a finisher unit 22 that performs predetermined processing on the sheet Y transported by the transport unit 21.

The post-processing apparatus 2 also includes a sheet processing controller 23 for controlling the respective mechanisms in the post-processing apparatus 2. The sheet processing controller 23 includes a CPU that is controlled by a program. The sheet processing controller 23 is connected to the controller 106 (see FIG. 1) via a signal line (not shown) and transmits and receives control signals, etc. to and from the controller 106.

The transport unit 21 of the post-processing apparatus 2 includes a punching functional part 30 for providing (punching) two, four, or other number of holes and transport rollers 211 for transporting the sheet Y having an image formed thereon in the image forming apparatus 1 to the finisher unit 22.

The finisher unit 22 includes a finisher unit body 221, a sheet collecting part 60 that collects a necessary number of sheets Y to form a sheet stack, and a binding unit 51 that performs binding (end binding) on an end of the sheet stack formed in the sheet collecting part 60.

The finisher unit 22 includes a rotatable transport roller 61 that is used to transport the sheet stack formed in the sheet collecting part 60. The finisher unit 22 also includes a movable roller 62, which is provided so as to be able to swivel about a rotation axis 62*a* and is movable between a position where it is retracted from the transport roller 61 and a position where it is pressed against transport roller 61.

The finisher unit 22 also includes a stacker 80, on which the sheet stack transported from the transport roller 61 and the movable roller 62 is stacked. The stacker 80 moves up or down according to the amount of sheet stack it supports.

When the post-processing apparatus 2 performs processing, first, a sheet Y is transported from the image forming apparatus 1 into the transport unit 21 of the post-processing apparatus 2.

In the transport unit 21, the sheet Y is punched by the punching functional part 30 and is then sent to the finisher unit 22 by the transport rollers 211.

When there is no punching instruction, the sheet Y is sent to the finisher unit 22, without being punched by the punching functional part 30.

The sheet Y sent to the finisher unit 22 is transported to the sheet collecting part 60. More specifically, the sheet Y is transported to a position above the sheet collecting part 60 and is then dropped onto the sheet collecting part 60. The sheet Y is supported from below by a support plate 67 provided in the sheet collecting part 60. The sheet Y then slides over the support plate 67 due to the inclination of the support plate 67 and due to a rotating paddle 69.

Thereafter, the sheet Y butts against an end guide 64 attached to an end of the support plate 67. Thus, in this exemplary embodiment, the movement of the sheet Y is stopped.

Thereafter, the above-described operation is performed each time a sheet Y is transported from the upstream side, and a sheet stack, in which the trailing ends of the sheets Y are aligned, is formed on the sheet collecting part 60.

Furthermore, in this exemplary embodiment, aligning members 65 for adjusting the position of the sheet stack in the width direction are provided so as to be movable in the sheet-stack width direction (i.e., the direction perpendicular to the plane of the sheet of FIG. 2).

There are two aligning members 65. One aligning member 65 is provided on one side and the other aligning member 65 is disposed on the other side of the sheet stack in the width direction.

In this exemplary embodiment, each time a sheet Y is fed to a position above the support plate 67, the widthwise ends (sides) of the sheet Y are pushed by the aligning members 65, and the widthwise position of the sheet Y (sheet stack) is adjusted.

When a predetermined number of sheets Y have been stacked on the support plate 67, and a sheet stack is formed on the support plate 67, the binding unit 51 performs binding processing on an end of the sheet stack.

The binding unit 51 includes two pressure-applying member pairs (a first pressure-applying member pair and a second pressure-applying member pair, described below) for applying pressure to the sheet stack. In this exemplary embodiment, one of the two pressure-applying member pairs is selected according to the number of sheets Y constituting the sheet stack, and the selected pressure-applying member pair performs binding processing.

The two pressure-applying member pairs each include an upper pressure-applying member and a lower pressure-applying member (described below). Furthermore, in this exemplary embodiment, an advancing-and-retracting mechanism 51A, serving as an example of an advancing-and-retracting part, for advancing and retracting the upper pressure-applying member and the lower pressure-applying member is provided.

In this exemplary embodiment, sheet stack binding processing is performed by pressing the upper pressure-applying member and the lower pressure-applying member against a sheet stack from both sides of the sheet stack (more specifically, by pressing the upper pressure-applying member and the lower pressure-applying member provided in one of the first pressure-applying member pair and the second pressure-applying member pair against the sheet stack), thereby press-bonding the sheets constituting the sheet stack. In other words, in this exemplary embodiment, binding processing on the sheet stack is performed without using staples or the like.

In this exemplary embodiment, once the binding processing on the sheet stack is completed, the movable roller 62 moves toward the transport roller 61, nipping the sheet stack between the movable roller 62 and the transport roller 61. Thereafter, the transport roller 61 and the movable roller 62 are rotated, transporting the sheet stack that has been subjected to the binding processing to the stacker 80.

Figure 3:
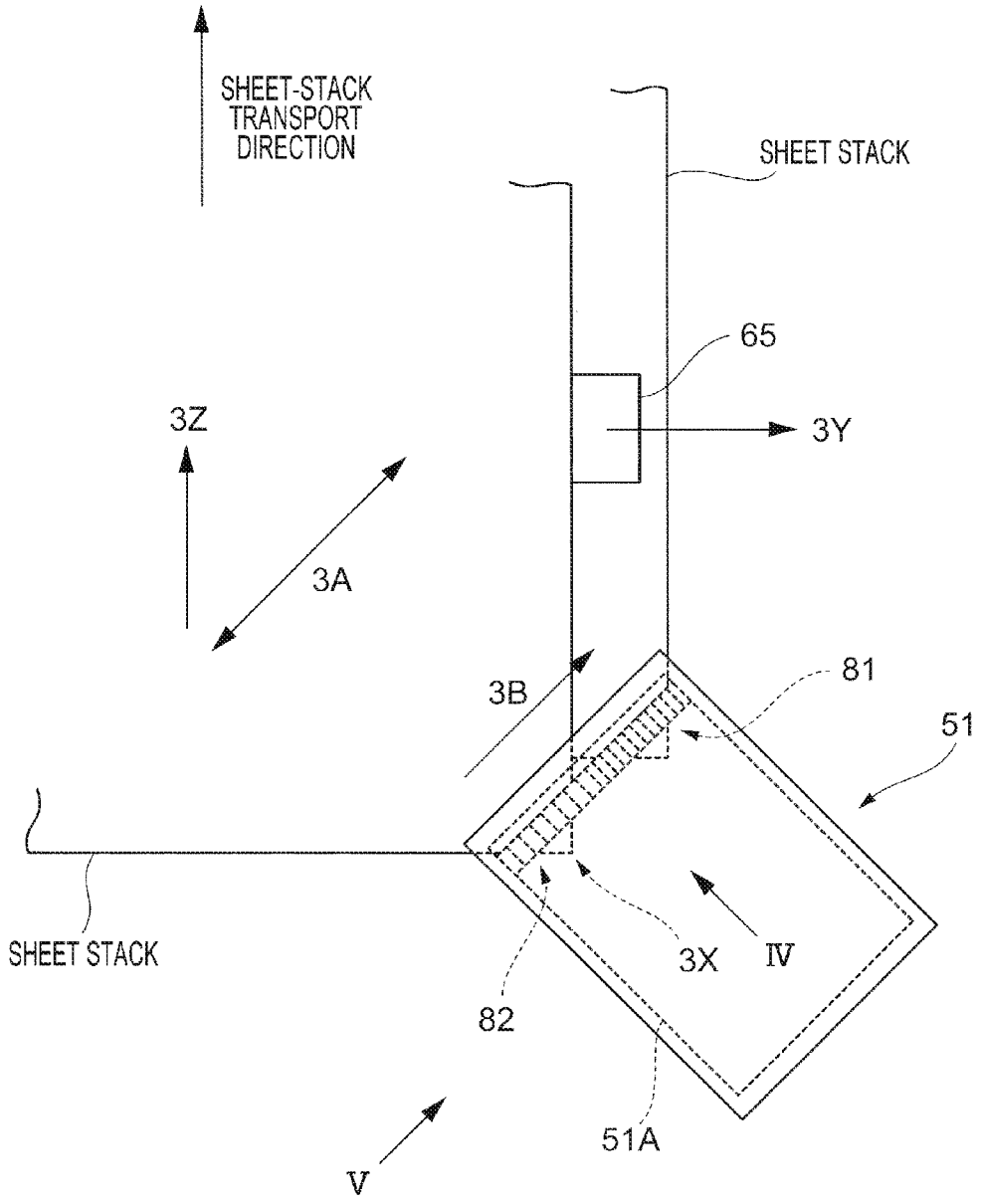
FIG. 3 shows a binding unit, etc., as viewed from an arrow III direction in FIG. 2.
Figure 4:
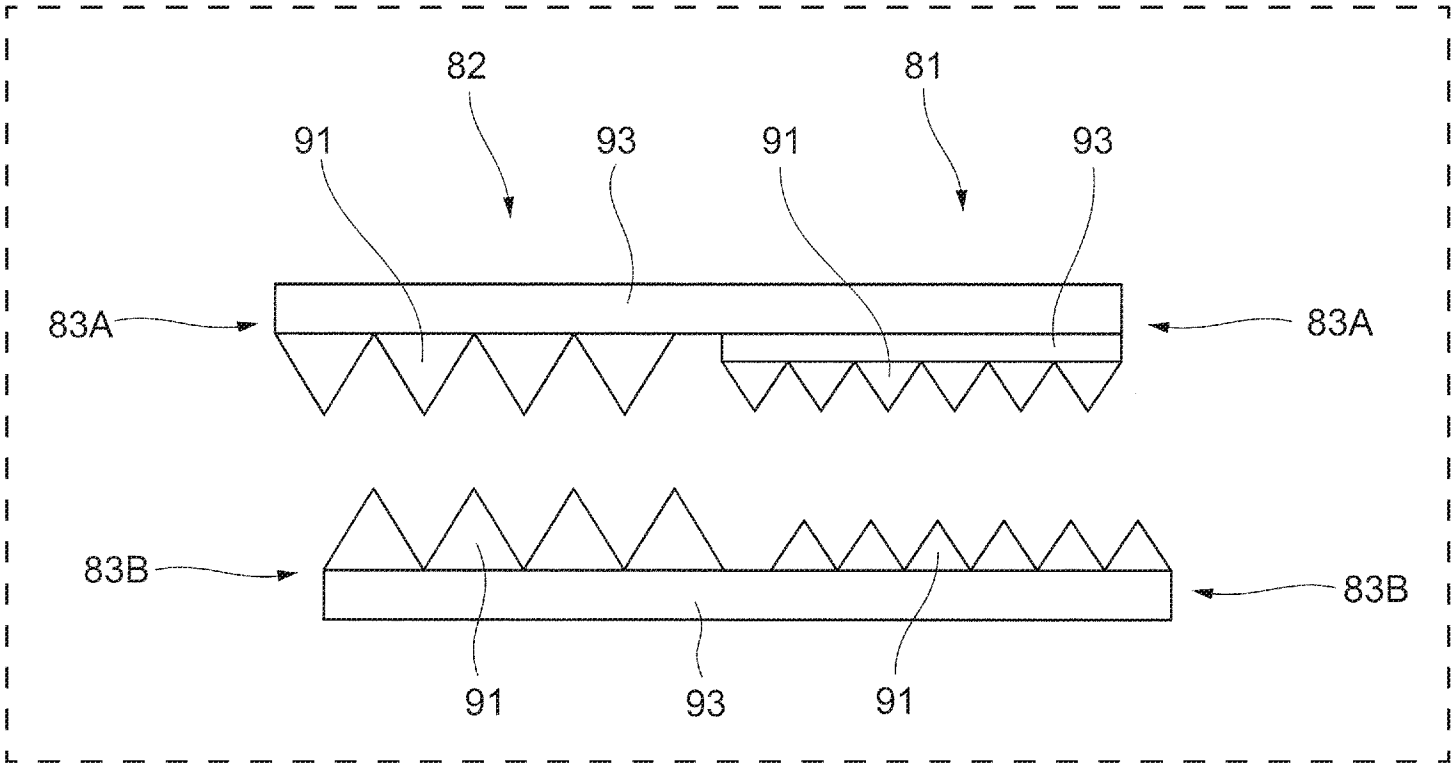
FIG. 4 shows a pressure-applying member pair, as viewed from an arrow IV direction in FIG. 3.

FIG. 3 shows the binding unit 51, etc., as viewed from an arrow III direction in FIG. 2. FIG. 4 shows the pressure-applying member pair, as viewed from an arrow IV direction in FIG. 3.

As shown in FIG. 3, the binding unit 51 according to this exemplary embodiment includes two pressure-applying member pairs, namely, a first pressure-applying member pair 81 and a second pressure-applying member pair 82. The first pressure-applying member pair 81 and the second pressure-applying member pair 82 are arranged side-by-side in the longitudinal direction of the first pressure-applying member pair 81.

As shown in FIG. 4, the first pressure-applying member pair 81 and the second pressure-applying member pair 82 each include an upper pressure-applying member 83A and a lower pressure-applying member 83B.

In this exemplary embodiment, the upper pressure-applying member 83A is pushed downward by the advancing-and-retracting mechanism 51A (see FIG. 3), thereby advancing toward the lower pressure-applying member 83B. As a result, the sheet stack (not shown in FIG. 4) located between the upper pressure-applying member 83A and the lower pressure-applying member 83B is pressed by the upper pressure-applying member 83A and the lower pressure-applying member 83B, and thus, the sheet-stack binding processing is performed.

As shown in FIG. 4, the upper pressure-applying member 83A and the lower pressure-applying member 83B each have multiple projections 91. These projections 91 are formed so as to extend in one direction (i.e., in the direction perpendicular to the plane of the sheet of FIG. 4). These projections 91 have a triangular shape in section.

These projections 91, which are formed so as to extend in one direction (i.e., the direction perpendicular to the plane of the sheet of FIG. 4), are arranged side-by-side in the direction perpendicular to the aforementioned one direction (i.e., in the left-right direction in FIG. 4).

In this exemplary embodiment, the first pressure-applying member pair 81 and the second pressure-applying member pair 82 each have rectangular-parallelepiped-shaped bases 93, and the projections 91 project from the surfaces of the bases 93.

In this exemplary embodiment, the projections 91 provided in the second pressure-applying member pair 82 are larger than the projections 91 provided in the first pressure-applying member pair 81. Furthermore, the pitch and the height of the projections 91 provided in the second pressure-applying member pair 82 are larger than the pitch and the height of the projections 91 provided in the first pressure-applying member pair 81.

In this exemplary embodiment, the upper pressure-applying member 83A of the first pressure-applying member pair 81 and the upper pressure-applying member 83A of the second pressure-applying member pair 82 are connected to each other (i.e., supported by the same base 93), and the upper pressure-applying member 83A of the first pressure-applying member pair 81 and the upper pressure-applying member 83A of the second pressure-applying member pair 82 are integrally moved.

Similarly, the lower pressure-applying member 83B of the first pressure-applying member pair 81 and the lower pressure-applying member 83B of the second pressure-applying member pair 82 are also integrated.

In this exemplary embodiment, as shown in FIG. 3, the binding unit 51 is disposed at an angle to the sheet-stack transport direction. In this exemplary embodiment, the binding unit 51 performs binding processing on a corner of the sheet stack.

In this exemplary embodiment, the pressure-applying member pair to be used can be switched. By moving the sheet stack in an arrow 3A direction in FIG. 3, the pressure-applying member pair to be used can be switched.

More specifically, in this exemplary embodiment, by moving the sheet stack with respect to the first pressure-applying member pair 81 and the second pressure-applying member pair 82, the pressure-applying member pair to be used can be switched.

In this exemplary embodiment, once a sheet stack has been formed on the support plate 67 (see FIG. 2), a corner (a corner denoted by reference sign 3X in FIG. 3) of the sheet stack is located between the upper pressure-applying member 83A and the lower pressure-applying member 83B of the second pressure-applying member pair 82 (see FIG. 4).

In this exemplary embodiment, from this state, the upper pressure-applying member 83A is advanced toward the lower pressure-applying member 83B. By doing so, the binding processing with the second pressure-applying member pair 82 is performed.

Although an exemplary case where the upper pressure-applying member 83A is advanced will be described in this exemplary embodiment, it is also possible that the lower pressure-applying member 83B is advanced or both the upper pressure-applying member 83A and the lower pressure-applying member 83B are advanced.

When binding processing is performed with the first pressure-applying member pair 81, the sheet stack is moved toward the first pressure-applying member pair 81, as shown by an arrow 3B in FIG. 3, and then binding processing is performed on the sheet stack. More specifically, in this exemplary embodiment, although a sheet stack is formed on the support plate 67, when binding processing is performed with the first pressure-applying member pair 81, the sheet stack formed on the support plate 67 is moved toward the first pressure-applying member pair 81, as shown by the arrow 3B.

The sheet stack is moved toward the first pressure-applying member pair 81 by the transport roller 61 (see FIG. 2), the movable roller 62, and the aligning members 65 (see FIG. 3).

More specifically, when the sheet stack is moved toward the first pressure-applying member pair 81, the aligning members 65 (FIG. 3 shows only one of the aligning members 65) provided on both sides of the sheet stack are moved in an arrow 3Y direction in FIG. 3. As a result, the sheet stack is pushed and moved in the width direction.

Furthermore, when the sheet stack is moved toward the first pressure-applying member pair 81, the movable roller 62 (see FIG. 2) is advanced toward the sheet stack, nipping the sheet stack between the transport roller 61 and the movable roller 62. Then, the transport roller 61 and the movable roller 62 are rotated, moving the sheet stack in an arrow 3Z direction in FIG. 3.

Through the above-described processing, the sheet stack has been moved in the arrow 3B direction in FIG. 3, and the corner of the sheet stack has reached the first pressure-applying member pair 81. In this way, the pressure-applying member pair to be used has been switched, and the binding processing with the first pressure-applying member pair 81 has become possible.

The transport roller 61, the movable roller 62, the aligning members 65, etc. may be regarded as a switching part for switching the pressure-applying member pair to be used.

In this exemplary embodiment, the pressure-applying member pair to be used is switched according to the number of sheets Y constituting the sheet stack. When the number of sheets Y constituting the sheet stack is large (more specifically, when the number of sheets Y constituting the sheet stack is 16 or more), the second pressure-applying member pair 82, which has the larger projections 91, is used.

On the other hand, when the number of sheets Y constituting the sheet stack is small (more specifically, when the number of sheets Y constituting the sheet stack is 15 or less), the first pressure-applying member pair 81, which has the smaller projections 91, is used.

Figure 5A:
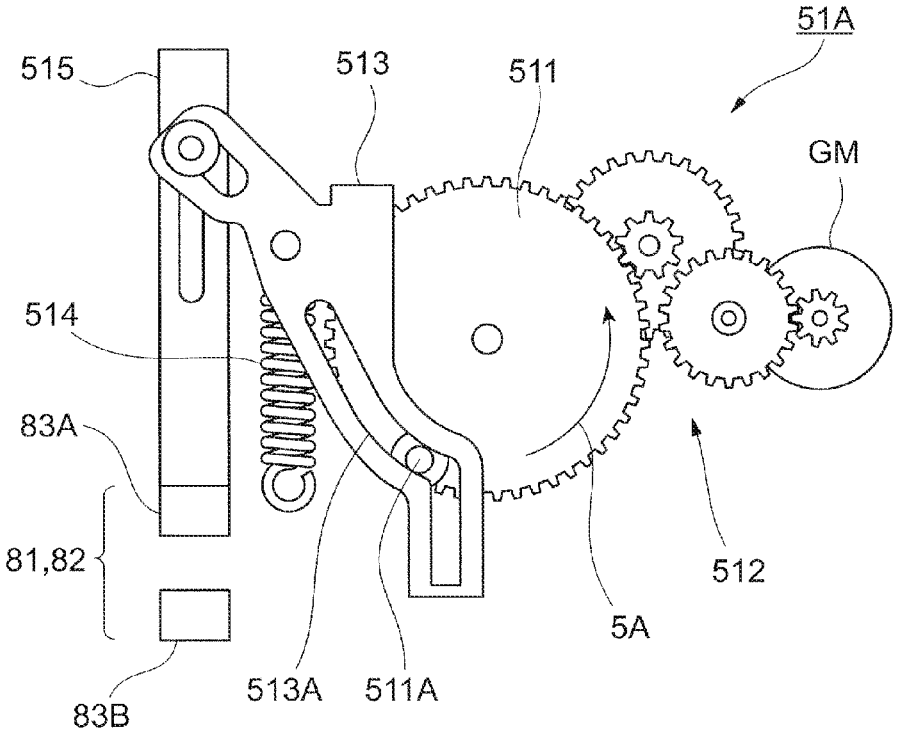
FIGS. 5A and 5B show an advancing-and-retracting mechanism, as viewed from an arrow V direction in FIG. 3.
Figure 5B:
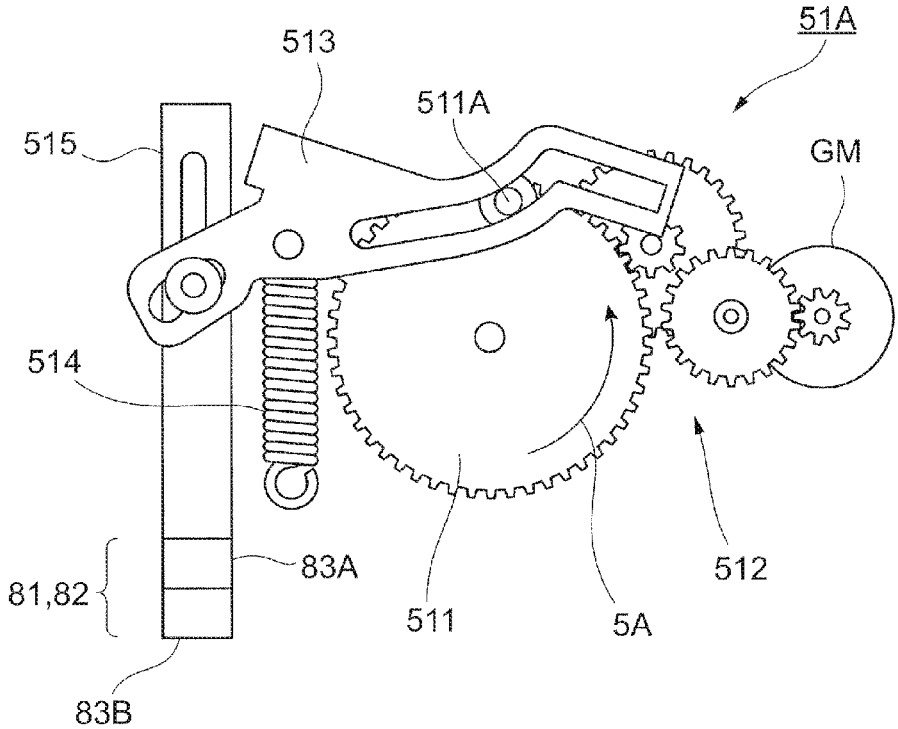

FIGS. 5A and 5B show the advancing-and-retracting mechanism 51A, as viewed from an arrow V direction in FIG. 3.

As shown in FIG. 5A, the advancing-and-retracting mechanism 51A according to this exemplary embodiment has a rotary gear 511. The advancing-and-retracting mechanism 51A also has a gear motor GM for rotating the rotary gear 511, and transmission gears 512 for transmitting the rotational driving force from the gear motor GM to the rotary gear 511. The rotary gear 511 has a projection 511A on a side surface thereof.

The advancing-and-retracting mechanism 51A also has a crank member 513, which can be swiveled. The crank member 513 has an elongated hole 513A, in which the projection 511A of the rotary gear 511 is positioned.

The advancing-and-retracting mechanism 51A also has a spring 514 for urging the crank member 513 downward, and an advancing-and-retracting member 515, which is attached to the left end of the crank member 513 (in FIGS. 5A and 5B) and advances and retracts in the up-and-down direction. In this exemplary embodiment, the upper pressure-applying members 83A provided on the first pressure-applying member pair 81 and the second pressure-applying member pair 82 are attached to the lower end of the advancing-and-retracting member 515.

FIG. 5A shows a state in which the advancing-and-retracting member 515 has been moved upward, and thus, the upper pressure-applying members 83A provided on the first pressure-applying member pair 81 and the second pressure-applying member pair 82 are retracted from the lower pressure-applying members 83B provided on the first pressure-applying member pair 81 and the second pressure-applying member pair 82.

When binding processing is performed, the gear motor GM is driven, rotating the rotary gear 511 in an arrow 5A direction in FIG. 5A. As a result, the rotary gear 511, etc. turn into the state shown in FIG. 5B.

In the state shown in FIG. 5B, the projection 511A of the rotary gear 511 is positioned on the upper side, and the right end of the crank member 513 (in FIG. 5B) is lifted upward.

Furthermore, the crank member 513 is pulled downward by the spring 514, moving the advancing-and-retracting member 515 downward. As a result, the upper pressure-applying member 83A provided on the first pressure-applying member pair 81 or the upper pressure-applying member 83A provided on the second pressure-applying member pair 82 is pressed against the sheet stack (not shown in FIGS. 5A and 5B). In this case, the sheet stack is nipped between the upper pressure-applying member 83A and the lower pressure-applying member 83B, whereby the sheets Y constituting the sheet stack are press-bonded.

Figure 6:
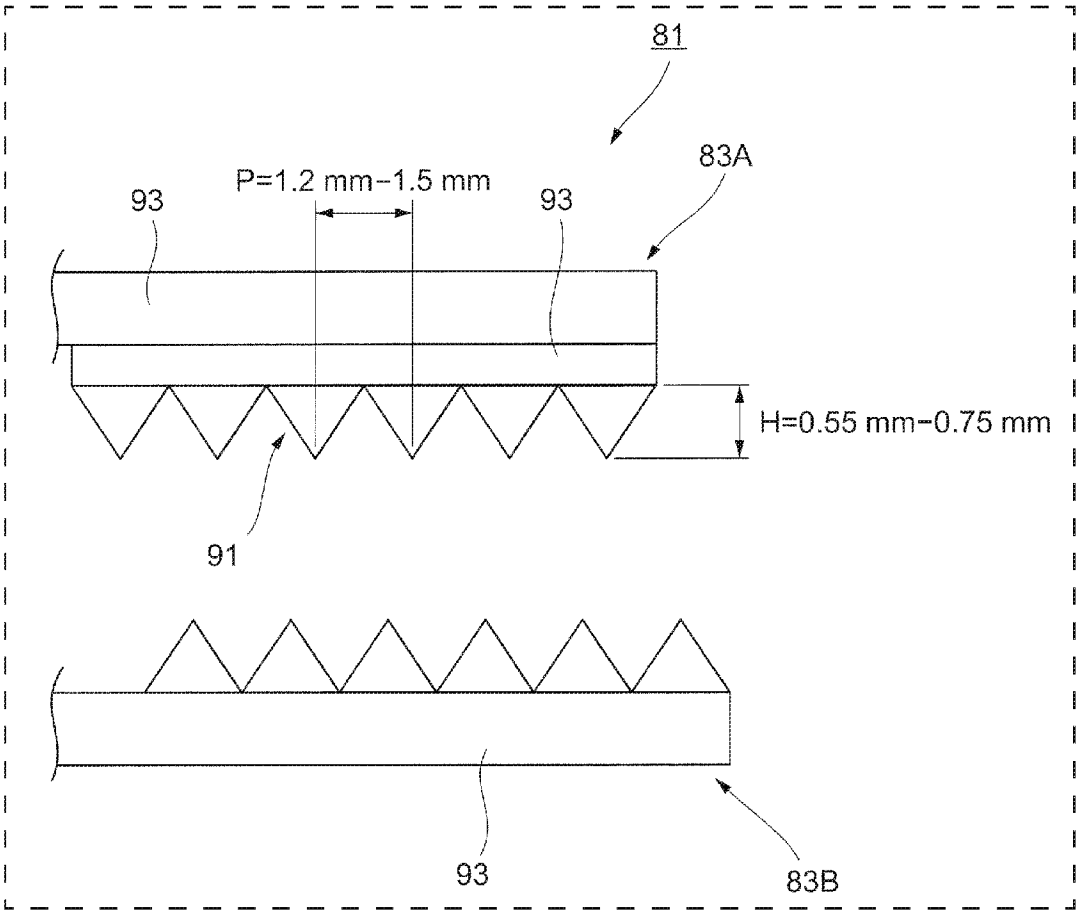
FIG. 6 is an enlarged view of a first pressure-applying member pair.
Figure 7:
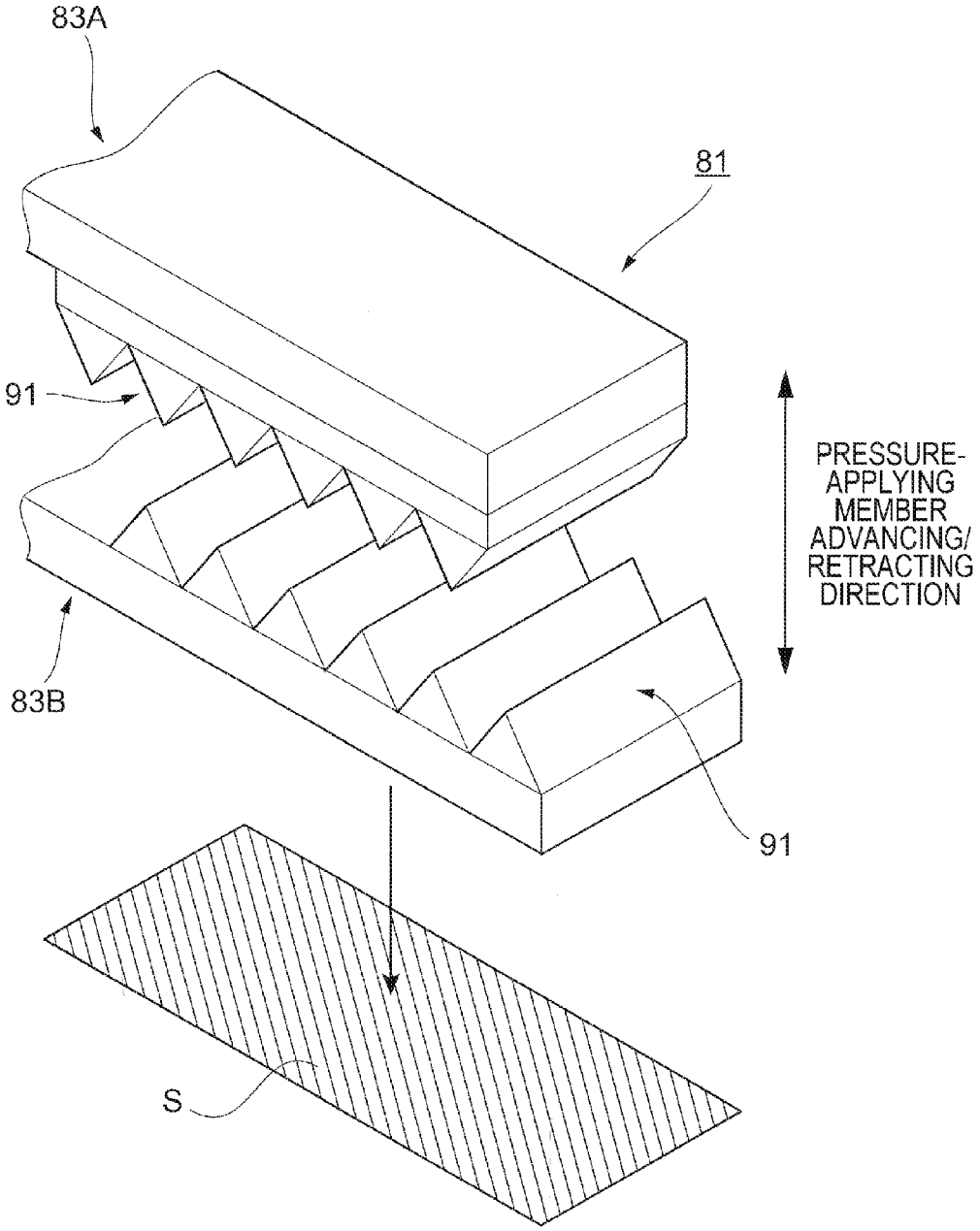
FIG. 7 is a perspective view of the first pressure-applying member pair.

FIG. 6 is an enlarged view of the first pressure-applying member pair 81, and FIG. 7 is a perspective view of the first pressure-applying member pair 81.

As shown in FIG. 6, in the upper pressure-applying member 83A and the lower pressure-applying member 83B provided on the first pressure-applying member pair 81, the pitch P of the projections 91 is from 1.2 mm to 1.5 mm, and the height H of the projections 91 (i.e., the distance between the base and the apex of the projections 91) is from 0.55 mm to 0.75 mm.

In the first pressure-applying member pair 81 according to this exemplary embodiment, the load per unit area applied from each of the pressure-applying members (the upper pressure-applying member 83A and the lower pressure-applying member 83B) to the sheet stack when the pressure-applying members apply pressure to the sheet stack is from 42 $N/mm^2$ to 94 $N/mm^2$.

The load per unit area is a value obtained by dividing the load applied from each pressure-applying member to the sheet stack when the pressure-applying member applies pressure to the sheet stack by the area of the pressure-applying member.

The area of each of the pressure-applying members (the upper pressure-applying member 83A and the lower pressure-applying member 83B) is, as shown in FIG. 7, an area S, which is obtained by projecting, in the pressure-applying-member-advancing-and-retracting direction, a region in the pressure-applying member in which the projections 91 are provided; that is, the area S is the area of the above-described region projected on a plane perpendicular to the advancing-and-retracting direction.

In other words, in this exemplary embodiment, the advancing-and-retracting mechanism 51A (see FIG. 2) applies a pressure-applying load to each of the pressure-applying members (the upper pressure-applying member 83A or the lower pressure-applying member 83B of the first pressure-applying member pair 81), and the load per unit area is a value obtained by dividing the pressure-applying load applied to each of the pressure-applying members (i.e., the pressure-applying load applied to one pressure-applying member) by the area S of the pressure-applying member.

With this configuration (numerical range), in this exemplary embodiment, binding processing on multiple types of sheet stack, in which the number of sheets Y is different, can be performed with one pressure-applying member pair (more specifically, only with the first pressure-applying member pair 81).

More specifically, in this exemplary embodiment, when the number of sheets Y in a sheet stack is two to fifteen, the sheet-stack binding processing can be performed only with the first pressure-applying member pair 81. More specifically, when the number of sheets Y contained in the sheet stack is two to fifteen, the binding processing can be performed only with the first pressure-applying member pair 81, without needing to switch the pressure-applying member pair to be used.

In the related art, it has often been difficult to perform binding processing on multiple types of sheet stack, in which the number of sheets Y is different, with a single pressure-applying member pair. Hence, in this case, for example, the pressure-applying member pair to be used is switched, according to the number of sheets Y in the sheet stack.

In this case, the processing is complex. In contrast, as in this exemplary embodiment, when binding processing can be performed on multiple types of sheet stack, in which the number of sheets Y is different, with a single pressure-applying member pair, the number of components can be reduced, and the processing can be simplified.

Example and Comparative Examples

FIGS. 8A to 8C show results of binding processing performed with the first pressure-applying member pair 81, in an example (see FIG. 8B) and comparative examples (see FIGS. 8A and 8C).

When the first pressure-applying member pair 81 according to this exemplary embodiment (the pitch P of the projections 91 is from 1.2 mm to 1.5 mm, and the height H of the projections 91 is from 0.55 mm to 0.75 mm) is used, and when the load per unit area applied from each of the pressure-applying members (the upper pressure-applying member 83A and the lower pressure-applying member 83B) to the sheet stack is from 42 N/mm$^2$ to 94 N/mm$^2$, the results are "○" or "Δ", as shown in FIG. 8 B, and thus, the strength of the binding part can be ensured.

In other words, when the above-mentioned three conditions (the pitch, height, and load) are satisfied, the strength of the binding part can be ensured in any of sheet stacks including two to three, four to five, six to nine, and ten to fifteen sheets Y.

A more preferred load range in this example is from 50 N/mm$^2$ to 86 N/mm$^2$. In this range, in any of the sheet stacks above, the results are "○", and the load applied to the sheet stack when the sheet stack is unbound is 200 gf or more.

More specifically, in this example, pages of a bound sheet stack are turned, and the load applied to the sheet stack when the sheet stack is unbound is measured.

Figure 12:
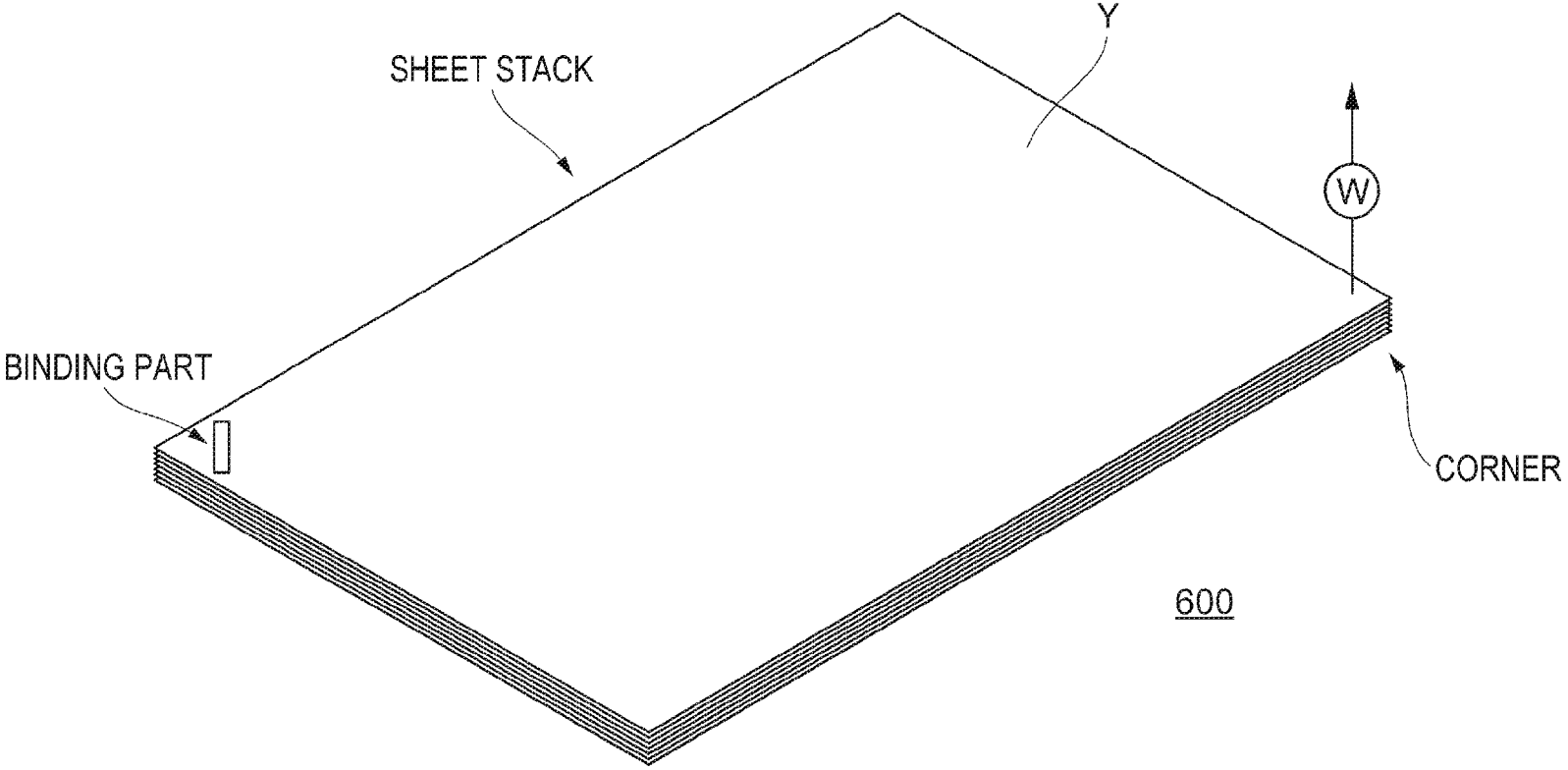
FIG. 12 shows an experimental procedure in the example and the comparative examples.

More specifically, as shown in FIG. 12, which shows an experimental procedure in the example and the comparative examples, the bound sheet stack (composed of A4-size normal paper) is disposed on a support surface 600, and a corner of some sheets Y in the upper part of the sheet stack, the corner being diagonally opposite to the binding part, is pulled upward.

More specifically, the corner of the upper half of the sheets Y constituting the sheet stack is pulled upward.

For example, when the number of sheets Y constituting the sheet stack is ten, the corner of five sheets Y from the top is pulled upward. When, for example, the number of sheets Y constituting the sheet stack is eleven, the corner of six sheets Y from the top is pulled upward. Specifically, when the number of sheets Y constituting the sheet stack is an odd number, the number is divided by two and rounded off to the nearest whole number, and the corner of this whole number of sheets Y is pulled upward.

When the corner is kept pulled upward, the sheet stack is unbound. In the example and the comparative examples, the tensile load applied when the sheet stack is unbound is measured with a load measuring instrument W disposed between the corner and an operator (a person who pulls the corner).

The results at the time when this tensile load is 200 gf or more are evaluated to be "○", the results at the time when this tensile load is 100 to 200 gf are evaluated to be "Δ", and the results at the time when this tensile load is 100 gf or less are evaluated to be "x".

Now, the comparative examples will be described.

In the comparative examples shown in FIGS. 8A and 8C, although the sheet stack is less likely to be unbound under some conditions, the sheet stack is easily unbound under the most conditions.

FIG. 8A shows the comparative example in which the pitch P of the projections 91 is 1 mm, and the height H of the projections 91 is 0.5 mm. In this case, although the sheet stack is less likely to be unbound when the sheet stack includes two to three or four to five sheets Y, and the load per unit area is from 18 N/mm$^2$ to 42 N/mm$^2$, the sheet stack is easily unbound under the other conditions.

More specifically, in this comparative example, although the binding strength can be ensured when the sheet stack includes two to three or four to five sheets Y, and the load per unit area is from 18 N/mm$^2$ to 42 N/mm$^2$, the binding strength cannot be ensured when the sheet stack includes seven or more sheets Y. In this case, unlike the case of this exemplary embodiment, an additional pressure-applying member pair for sheet stacks including seven or more sheets Y is required, and switching of the pressure-applying member pair to be used is also required.

FIG. 8A shows the results under one condition in which the pitch P and the height H of the projections 91 are lower than the numerical ranges in this exemplary embodiment. However, according to experiments performed by the inventor, also in other conditions in which the pitch P and the height H of the projections 91 are lower than the numerical ranges in this exemplary embodiment, the binding strength cannot be ensured.

FIG. 8A shows the results in the case where both of the pitch P and the height H are lower than the numerical ranges in this exemplary embodiment. However, according to experiments performed by the inventor, also in cases where only one of the pitch P and the height H is lower than the numerical range in this exemplary embodiment, the binding strength cannot be ensured.

FIG. 8C shows the comparative example in which the pitch P of the projections 91 is 1.9 mm, and the height H of the projections 91 is 0.9 mm. In this case, although the sheet stack is less likely to be unbound when the sheet stack includes six to nine or ten to fifteen sheets Y, and the load per unit area is from 94 N/mm$^2$ to 108 N/mm$^2$, the sheet stack is easily unbound under the other conditions.

More specifically, in this comparative example, the binding strength can be ensured when the sheet stack includes six to nine or ten to fifteen sheets Y, and when the load per unit area is from 94 N/mm$^2$ to 108 N/mm$^2$. However, the binding strength cannot be ensured when the sheet stack includes five or less sheets Y. In this case, an additional pressure-applying member pair for sheet stacks including five or less sheets Y is required, and switching of the pressure-applying member pair to be used is also required.

FIG. 8C shows, similarly to FIG. 8A, the results under one condition in which the pitch P and the height H of the projections 91 are higher than the numerical ranges in this exemplary embodiment. However, according to experiments performed by the inventor, the binding strength cannot be ensured also in other conditions in which the pitch P and the height H of the projections 91 are higher than the numerical ranges in this exemplary embodiment.

FIG. 8C shows the results in the case where both of the pitch P and the height H are higher than the numerical ranges in this exemplary embodiment. However, according to experiments performed by the inventor, also in cases where only one of the pitch P and the height H is higher than the numerical ranges in this exemplary embodiment, the binding strength cannot be ensured.

Next, switching of the pressure-applying member pair to be used will be described. Although the pressure-applying member pair to be used is switched by moving the sheet stack in the configuration example shown in FIG. 3, the pressure-applying member pair to be used may be switched by moving the first pressure-applying member pair 81 and the second pressure-applying member pair 82.

Figure 9B:
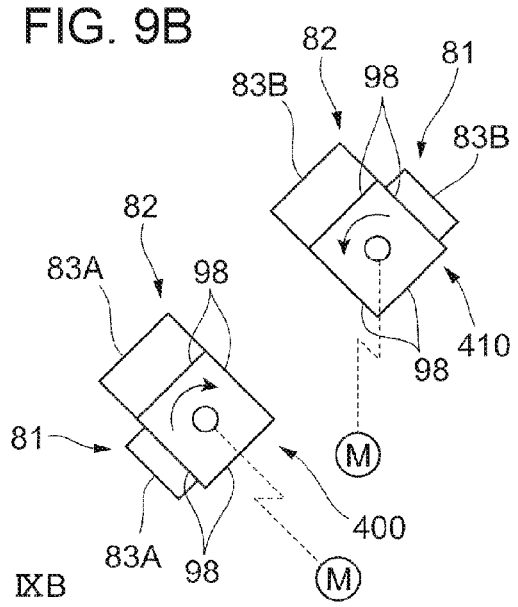
FIGS. 9A and 9B show another configuration example of the binding unit.
Figure 9A:
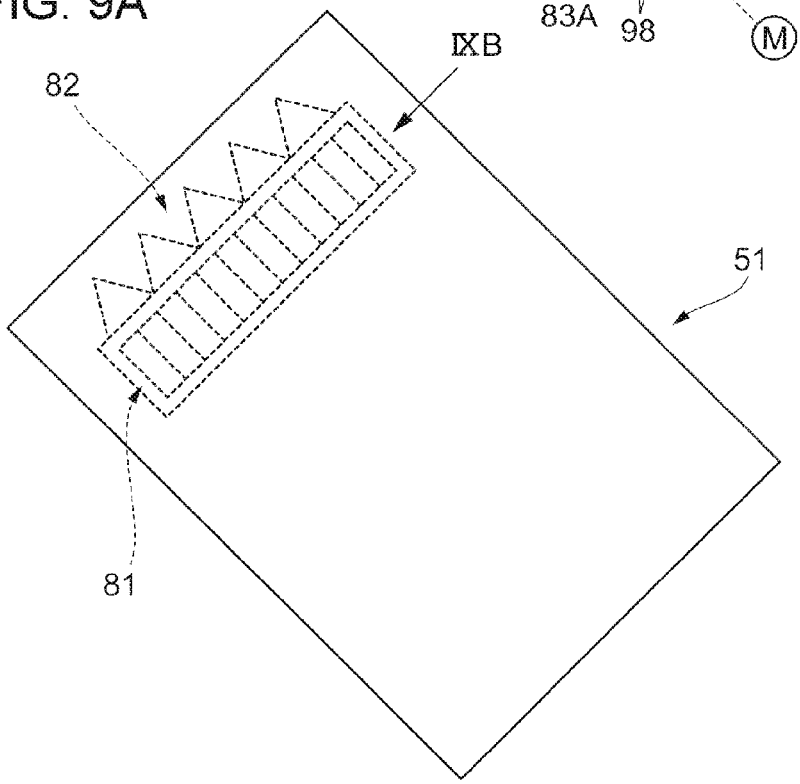

FIGS. 9A and 9B show another configuration example of the binding unit 51. FIG. 9B shows the first pressure-applying member pair 81 and the second pressure-applying member pair 82, as viewed from an arrow IXB direction in FIG. 9A.

In this configuration example, as shown in FIG. 9B, an upper rotary member 400 and a lower rotary member 410, which oppose each other, are provided, and rotary motors M for rotating the upper rotary member 400 and the lower rotary member 410 are provided. The upper rotary member 400 and the lower rotary member 410 are formed in the shape of a square pole and each have four side surfaces 98.

As shown in FIG. 9B, the upper pressure-applying member 83A of the first pressure-applying member pair 81 is provided on a side surface 98 of the upper rotary member 400, and the upper pressure-applying member 83A of the second pressure-applying member pair 82 is provided on another side surface 98 of the upper rotary member 400.

The lower pressure-applying member 83B of the first pressure-applying member pair 81 is provided on a side surface 98 of the lower rotary member 410, and the lower pressure-applying member 83B of the second pressure-applying member pair 82 is provided on another side surface 98 of the lower rotary member 410.

In this configuration example, for example, when the upper pressure-applying member 83A of the second pressure-applying member pair 82 and the lower pressure-applying member 83B of the second pressure-applying member pair 82 are made to oppose each other, the upper rotary member 400 and the lower rotary member 410 are rotated by 90 degrees in the directions indicated by arrows in FIG. 9B, from the state shown in FIG. 9B. As a result, the upper pressure-applying member 83A and the lower pressure-applying member 83B constituting the second pressure-applying member pair 82 oppose each other.

Thereafter, in this configuration example, the advancing-and-retracting mechanism 51A (see FIG. 2) is driven. As a result, the second pressure-applying member pair 82 is pressed against the sheet stack, and the sheet-stack binding processing is performed.

When the binding processing is performed with the first pressure-applying member pair 81 from the state in which the upper pressure-applying member 83A and the lower pressure-applying member 83B constituting the second pressure-applying member pair 82 oppose each other (i.e., when the pressure-applying member pair to be used is switched), the upper rotary member 400 and the lower rotary member 410 are rotated again by 90 degrees.

As a result, the upper pressure-applying member 83A and the lower pressure-applying member 83B constituting the first pressure-applying member pair 81 oppose each other. Then, similarly to the above, the advancing-and-retracting mechanism 51A (see FIG. 2) is driven. As a result, the first pressure-applying member pair 81 is pressed against the sheet stack, and the sheet-stack binding processing is performed.

In this configuration example, the area occupied by the binding unit 51 can be reduced, compared with a case where the pressure-applying member pair to be used is switched by sliding the first pressure-applying member pair 81 and the second pressure-applying member pair 82. The pressure-applying member pair to be used may also be switched by, for example, sliding the first pressure-applying member pair 81 and the second pressure-applying member pair 82, as shown in FIG. 3, in the arrow 3A direction in FIG. 3.

However, in this case, the spaces for the two pressure-applying member pairs need to be ensured, increasing the area occupied by the binding unit 51.

In contrast, as in this exemplary embodiment, when the first pressure-applying member pair 81 and the second pressure-applying member pair 82 are provided on the rotary members, the space for the first pressure-applying member pair 81 and the space for the second pressure-applying member pair 82 overlap each other, reducing the area occupied by the binding unit 51.

Figure 10B:
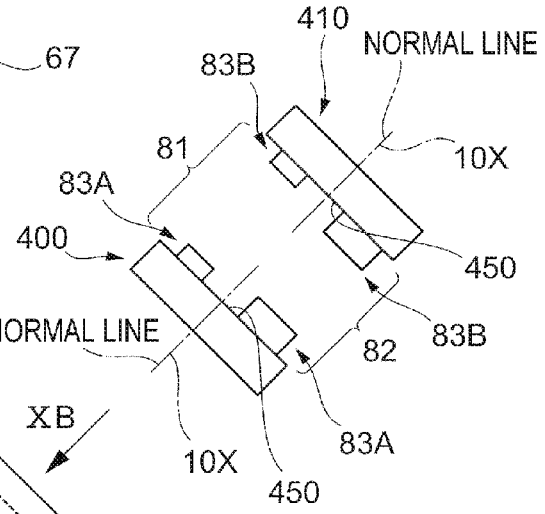
FIGS. 10A and 10B show another configuration example of the binding unit.
Figure 10A:
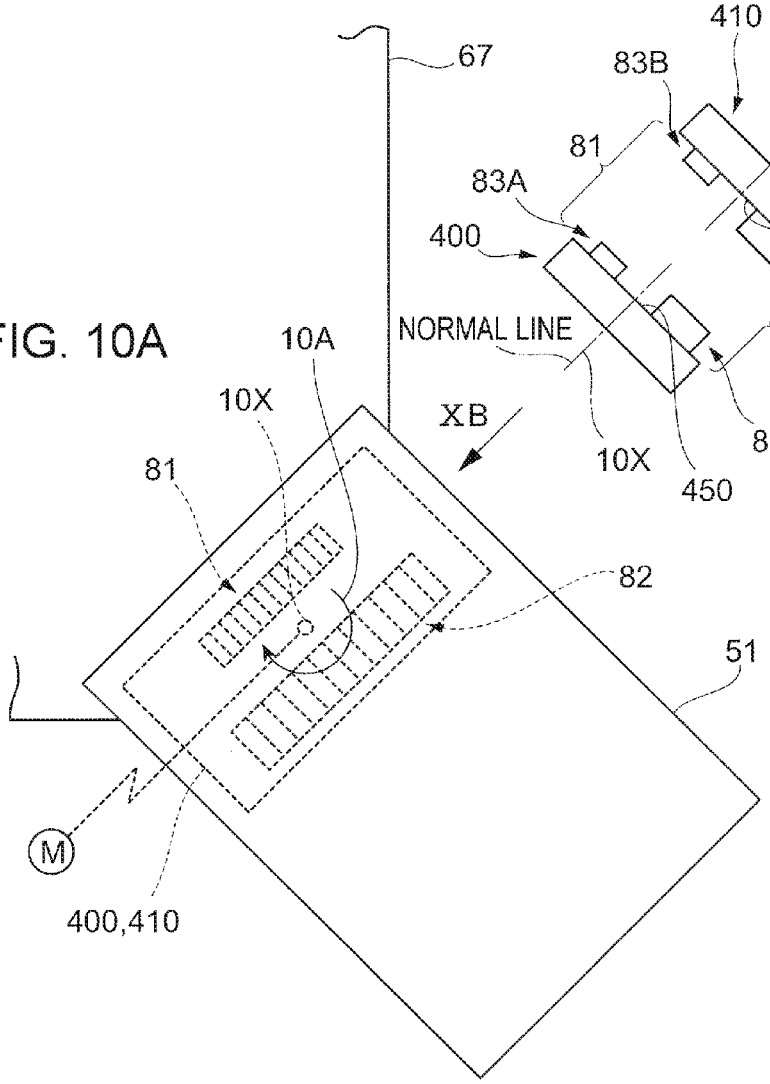

FIGS. 10A and 10B show another configuration example of the binding unit 51. FIG. 10B shows the first pressure-applying member pair 81 and the second pressure-applying member pair 82, as viewed from an arrow XB direction in FIG. 10A.

Also in this configuration example, as shown in FIG. 10B, an upper rotary member 400 and a lower rotary member 410, which oppose each other, are provided. The upper rotary member 400 and the lower rotary member 410 are formed in a plate shape and oppose each other. The upper rotary member 400 and the lower rotary member 410 each have an opposing surface 450, which faces the counterpart rotary member.

The upper rotary member 400 and the lower rotary member 410 are rotatable about the line normal to the opposing surfaces 450. In other words, the upper rotary member 400 and the lower rotary member 410 rotate about a rotation axis 10X, which is parallel to the line normal to the opposing surfaces 450.

Furthermore, in this configuration example, a rotary motor M for rotating the upper rotary member 400 and the lower rotary member 410 in an arrow 10A direction in FIG. 10A is provided.

As shown in FIG. 10B, the upper pressure-applying member 83A of the first pressure-applying member pair 81 is provided on the opposing surface 450 of the upper rotary member 400, and the upper pressure-applying member 83A of the second pressure-applying member pair 82 is also provided on the opposing surface 450 of the upper rotary member 400.

In the upper rotary member 400, the upper pressure-applying member 83A of the first pressure-applying member pair 81 is provided in one of two regions adjoining via the rotation axis 10X of the upper rotary member 400, and the upper pressure-applying member 83A of the second pressure-applying member pair 82 is provided in the other of the two regions.

The lower pressure-applying member 83B of the first pressure-applying member pair 81 is provided on the opposing surface 450 of the lower rotary member 410, and the lower pressure-applying member 83B of the second pressure-applying member pair 82 is also provided on the opposing surface 450 of the lower rotary member 410.

Similarly to the upper rotary member 400, in the lower rotary member 410, the lower pressure-applying member 83B of the first pressure-applying member pair 81 is provided in one of two regions adjoining via the rotation axis 10X of the lower rotary member 410, and the lower pressure-applying member 83B of the second pressure-applying member pair 82 is provided in the other of the two regions.

In the state shown in FIG. 10A, the first pressure-applying member pair 81 is located closer to the support plate 67 (see also FIG. 2). In this state, the binding processing with the first pressure-applying member pair 81 can be performed.

More specifically, in the state shown in FIG. 10A, the upper rotary member 400 (see FIG. 10B) is moved toward the lower rotary member 410 by driving the advancing-and-retracting mechanism 51A (see FIG. 2), and, as a result, the binding processing with the first pressure-applying member pair 81 can be performed.

When the pressure-applying member pair to be used is switched, the rotary motor M is driven to rotate the upper rotary member 400 and the lower rotary member 410 by 180° from the state shown in FIG. 10A. As a result, the second pressure-applying member pair 82 is located closer to the support plate 67. Then, similarly to the above, the advancing-and-retracting mechanism 51A (see FIG. 2) is driven to move the upper rotary member 400 toward the lower rotary member 410. In this way, the binding processing with the second pressure-applying member pair 82 is performed.

Figure 11B:
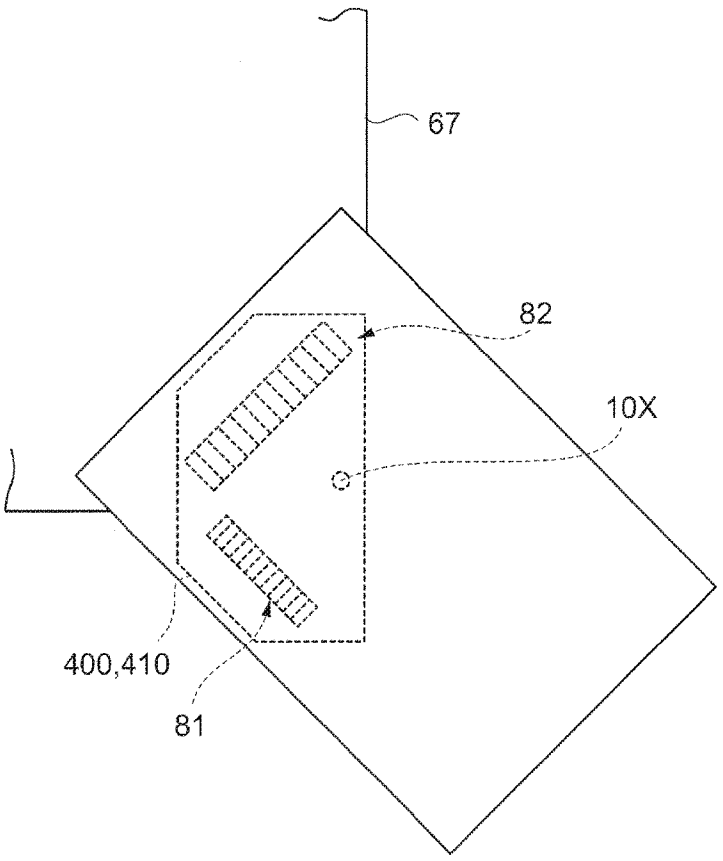
FIGS. 11A and 11B show another configuration example of the binding unit.
Figure 11A:
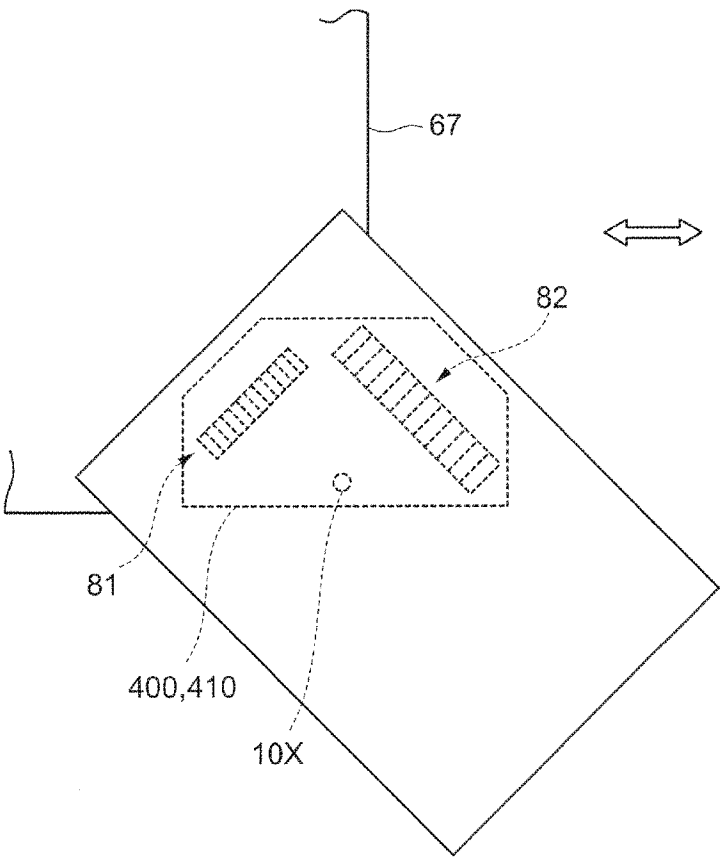

FIGS. 11A and 11B show another configuration example of the binding unit 51. FIG. 11A shows a state of the binding unit 51 when binding processing is performed with the first pressure-applying member pair 81, and FIG. 11B shows a state of the binding unit 51 when binding processing is performed with the second pressure-applying member pair 82.

Also in this configuration example, similarly to FIG. 10, the upper rotary member 400 and the lower rotary member 410 are rotated about the rotation axis 10X, which is parallel to the line normal to the opposing surfaces 450 (not shown in FIG. 11) of the upper rotary member 400 and the lower rotary member 410.

In the configuration example shown in FIGS. 10A and 10B, the first pressure-applying member pair 81 and the second pressure-applying member pair 82 are provided on both sides of the rotation axis 10X, and the upper rotary member 400 and the lower rotary member 410 are rotated by 180° when the pressure-applying member pair to be used is switched.

In contrast, in this configuration example, as shown in FIG. 11, the first pressure-applying member pair 81 and the second pressure-applying member pair 82 are provided in one of two regions adjoining via the rotation axis 10X.

In this case, the pressure-applying member pair to be used can be switched by rotating the upper rotary member 400 and the lower rotary member 410 by an angle less than 180°.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding processing apparatus comprising:

a pressure-applying member pair that has a plurality of projections arranged side-by-side and applies pressure to a sheet stack by pressing the projections against the sheet stack; and an advancing-and-retracting part that causes at least one of the pressure-applying members in the pressure-applying member pair to move toward or away from the other pressure-applying member, wherein a pitch of the projections in each pressure-applying member is from 1.2 mm to 1.5 mm, and a height of the projections is from 0.55 mm to 0.75 mm, and the advancing and retracting part is configured to apply a load per unit area from each pressure-applying member to the sheet stack when the pressure-applying member applies pressure to the sheet stack from 42 $N/mm^2$ to 94 $N/mm^2$.

2. The binding processing apparatus according to claim 1, wherein the load per unit area applied from each pressure-applying member to the sheet stack is from 50 $N/mm^2$ to 86 $N/mm^2$.

3. The binding processing apparatus according to claim 2, further comprising:

in addition to the pressure-applying member pair, another pressure-applying member pair for applying pressure to the sheet stack; and a switching part for switching the pressure-applying member pair to be used to apply pressure to the sheet stack.

4. The binding processing apparatus according to claim 3, wherein the switching part switches the pressure-applying member pair to be used by moving the sheet stack.

5. The binding processing apparatus according to claim 3, wherein the switching part switches the pressure-applying member pair to be used by moving the pressure-applying member pair.

6. The binding processing apparatus according to claim 3, wherein the plurality of pressure-applying member pairs are attached to rotary members, and the switching part switches the pressure-applying member pair to be used by rotating the rotary members.

7. The binding processing apparatus according to claim 1, further comprising:

in addition to the pressure-applying member pair, another pressure-applying member pair for applying pressure to the sheet stack; and a switching part for switching the pressure-applying member pair to be used to apply pressure to the sheet stack.

8. The binding processing apparatus according to claim 7, wherein the switching part switches the pressure-applying member pair to be used by moving the sheet stack.

9. The binding processing apparatus according to claim 7, wherein the switching part switches the pressure-applying member pair to be used by moving the pressure-applying member pair.

10. The binding processing apparatus according to claim 7, wherein the plurality of pressure-applying member pairs are attached to rotary members, and the switching part switches the pressure-applying member pair to be used by rotating the rotary members.

11. An image forming system comprising:

an image forming part that forms an image on a sheet; and a binding processing apparatus that performs binding processing on a plurality of sheets having images formed thereon by the image forming part, wherein the binding processing apparatus is the binding processing apparatus according to claim 1.

* * * * *